US006982245B1

(12) United States Patent
Faubel et al.

(10) Patent No.: US 6,982,245 B1
(45) Date of Patent: Jan. 3, 2006

(54) PORTIONED CLEANING SHAPED BODIES

(75) Inventors: Heiko Faubel, Wermelskirchen (DE); Francois Prebin, Condesurmarne (FR); Gerd Rupietta, Grevenbroich (DE); Karl-Heinz Rogmann, Ratingen (DE); Heiko Hiltner, Ratingen (DE); Barbara Zupp, Langenfeld (DE)

(73) Assignee: Ecolab GmbH & Co. OHG, Dusseldorf (DE)

( * ) Notice: Subject to any disclaimer, the term of this patent is extended or adjusted under 35 U.S.C. 154(b) by 251 days.

(21) Appl. No.: 10/048,043

(22) PCT Filed: Jul. 18, 2000

(86) PCT No.: PCT/EP00/06839

§ 371 (c)(1),
(2), (4) Date: May 14, 2002

(87) PCT Pub. No.: WO01/07558

PCT Pub. Date: Feb. 1, 2001

(30) Foreign Application Priority Data

Jul. 27, 1999 (DE) ..... 199 35 257

(51) Int. Cl.
*C11D 11/00* (2006.01)

(52) U.S. Cl. ..... 510/406; 510/224; 510/298; 510/441; 510/446

(58) Field of Classification Search ..... 510/406, 510/224, 296, 298, 439, 446, 405, 365, 441
See application file for complete search history.

(56) References Cited

U.S. PATENT DOCUMENTS

| | | | | | |
|---|---|---|---|---|---|
| 4,115,292 | A | | 9/1978 | Richardson et al. | 510/392 |
| 4,877,459 | A | * | 10/1989 | Cockrell et al. | 134/40 |
| 5,234,615 | A | * | 8/1993 | Gladfelter et al. | 510/439 |
| 5,294,361 | A | * | 3/1994 | Van den Brom | 510/224 |
| 5,316,688 | A | * | 5/1994 | Gladfelter et al. | 510/224 |
| 5,338,480 | A | * | 8/1994 | Dziabo et al. | 252/187.21 |
| 5,759,988 | A | * | 6/1998 | Heile et al. | 510/441 |
| 5,885,949 | A | * | 3/1999 | Stamm | 510/180 |
| 5,980,641 | A | * | 11/1999 | Jakubowski | 134/1 |
| 6,057,281 | A | * | 5/2000 | Stamm | 510/446 |
| 6,150,324 | A | * | 11/2000 | Lentsch et al. | 510/446 |

FOREIGN PATENT DOCUMENTS

| | | |
|---|---|---|
| EP | 0 949 327 A1 | 10/1999 |
| WO | WO 97/35955 | 10/1997 |

* cited by examiner

*Primary Examiner*—Lorna M. Douyon
(74) *Attorney, Agent, or Firm*—Merchant & Gould P.C.

(57) ABSTRACT

The invention relates to portioned cleaning shaped bodies which are comprised of solid cleaning agent and of a water-soluble coating and which are used for producing liquid cleaning agent concentrates. The invention also relates to the use of the cleaning shaped bodies in the area of building cleaning or industrial cleaning services or in the area of household cleaning.

6 Claims, No Drawings

PORTIONED CLEANING SHAPED BODIES

FIELD OF THE INVENTION

This invention relates to portioned shaped cleaning bodies consisting of a solid powder-form cleaner and a water-soluble shell for the preparation of liquid cleaning concentrates and to their use in the cleaning of buildings or in the institutional cleaning service industry or in domestic cleaning.

BACKGROUND

SUMMARY OF THE INVENTION

In the cleaning service industry, it is common practice for superconcentrates to be purchased from the manufacturer of cleaning products and for cleaning concentrates to be prepared as required by dilution with water using equipment or containers of the cleaning contractor. In order to provide the cleaning staff with sufficient quantities, the cleaning concentrate is generally prepared in large amounts of 100 liters or more. The contractor's cleaning staff place the required amount of concentrate in relatively small containers, such as bottles or canisters for example, for use in cleaning operations.

The disadvantage of this practice is that the contractor's staff have to transport the particular amounts of cleaning concentrate required from the stockroom or point of preparation to the point of use. This is all the more labor-intensive when cleaning concentrates have to be prepared for several applications such as, for example, window cleaning, floor cleaning and other surface cleaning applications. So far as transportation is concerned, the particular cleaning contractor simply has to accept the weight of the liquid cleaning concentrates and has to have the necessary space available. Another consequence of this practice is that the contractor's staff have little flexibility. Either they have to take large quantities with them—sufficient even for unforeseeable cleaning work—or they have to fetch supplies from the stockroom or point of preparation. Disadvantages, such as the weight of and space occupied by liquid cleaning concentrates, also apply to the domestic sector.

The problem addressed by the present invention was to provide highly concentrated shaped cleaning bodies which would enable cleaning concentrates to be prepared in situ by dilution with water and which could be used in the cleaning of buildings by cleaning contractors and generally in the institutional cleaning service industry or in the domestic sector.

Accordingly, the present invention relates to shaped cleaning bodies for the preparation of a liquid cleaning concentrate, characterized in that the shaped cleaning body consists of a solid cleaner, preferably in powder, granular or paste form, and a water-soluble shell surrounding the solid cleaner. The shaped cleaning body preferably has an elongate narrow form.

The shaped cleaning body preferably has a width of 1 to 3 cm at its widest point where it is cylindrical, elliptical or rectangular in shape. In another preferred embodiment, the length of the shaped cleaning body is at least twice its width at its widest point where it is cylindrical, elliptical or rectangular in shape. The solid cleaner preferably contains one or more of the ingredients typical of surface cleaners selected from the group consisting of nonionic, anionic, cationic or amphoteric surfactants, carbonates, sulfates or phosphates or components with complexing properties, acids and perfume and dyes. The water-soluble shell preferably contains one or more components selected from the group of polymers. In a particularly preferred embodiment, polyvinyl alcohol at least is present as the polymer. In a most particularly preferred embodiment, the shell consists entirely of polyvinyl alcohol.

Corresponding shaped cleaning bodies are used in the domestic sector and preferably in the cleaning of buildings by cleaning contractors and generally in the institutional cleaning service industry.

The present invention also relates to a process for the preparation of a cleaning concentrate in which a) a shaped cleaning body according to the invention is placed in the form of a portion, i.e. without previous quantity measurement, in a container with a particular holding capacity and b) the container is filled with water to form a cleaning concentrate containing a particular quantity of active ingredients or c) a shaped cleaning body according to the invention is placed in the form of a portion, i.e. without previous quantity measurement, in a container with a particular holding capacity already filled with water to form a cleaning concentrate containing a particular quantity of active ingredients.

The containers with a particular holding capacity preferably consist of plastic, glass or metals and preferably have a holding capacity of 0.3 to 10 liters and preferably 0.5 to 2.5 liters. For example, bottles in the form of typical standard bottles as known, for example, in the beverage industry may be used.

The shaped cleaning body is contacted with water in a ratio by volume of preferably 1:10 to 1:300 and gives a liquid cleaning concentrate which, on further dilution with water by a factor of 10 to 300, forms a ready-to-use solution for the cleaning of surfaces, but which may also be used without dilution.

The present invention also relates to a system—consisting of shaped cleaning bodies according to the invention combined with containers having a particular holding capacity that are preferably made of plastic, glass or metals and preferably have a holding capacity of 0.3 to 10 liters, the dimensions of the shaped cleaning body and the size of the container opening being co-ordinated with one another—which is suitable for providing a cleaning concentrate by contacting the shaped cleaning body in the container with the particular holding capacity with water in a ratio by volume of 1:10 to 1:300, the cleaning concentrate forming a ready-to-use solution for cleaning surfaces by further dilution with water by a factor of 10 to 300 or being directly used without any further dilution. Corresponding systems are intended for the cleaning sector, for example for domestic cleaning and preferably for the cleaning of buildings by cleaning contractors and generally for the institutional cleaning service industry.

The present invention affords several advantages. The particular quantities of cleaning concentrate required no longer have to be transported from the stockroom or point of preparation to the point of use, instead the cleaning concentrate can be prepared in situ simply by dissolving a single shaped cleaning body in water. Where cleaning concentrates are required for several applications such as, for example, window cleaning, floor cleaning, sanitary cleaning and other surface cleaning applications, it is convenient for the cleaning contractor to keep a supply of several different shaped cleaning bodies and flexibly to prepare the particular cleaning concentrate required in situ as and when required. When it comes to transportation, the contractor no longer has to put up with the weight of the liquid cleaning concentrates or to have the necessary space available for them because the shaped cleaning bodies take up far less space and are considerably lighter in weight. The advantages arising out of the lighter weight and compactness of the tablets also apply in the domestic sector.

EXAMPLES

As described above, solid cleaning formulations may be present in shells designed in accordance with the invention. For example, the following exemplary formulations were accommodated in cylindrical water-soluble shells with a length of 150 mm and a diameter of 30 mm. The same exemplary formulations were accommodated in a water-soluble shell of elliptical cross-section, the major diameter of the ellipse being 25 mm and the minor diameter 12 mm for a length of 80 mm.

| Example 1: powder, alkaline | |
|---|---|
| Sodium carbonate | 45.0% |
| Potassium carbonate | 15.0% |
| Sodium tripolyphosphate | 16.0% |
| FA + EO (5–25) | 4.5% |
| ABS Na | 6.0% |
| Nitrilotriacetic acid (Na salt) | 3.2% |
| Rest = additives (dye, perfume, dust binder, etc.) | to 100% |

| Example 2: powder, acidic | |
|---|---|
| Sodium carbonate | 2.0% |
| Amidosulfonic acid | 30.0% |
| Citric acid | 15.0% |
| Na gluconate | 10.0% |
| Alkane sulfonate | 5.0% |
| FA + EO (5–25) | 8.0% |
| Sodium sulfate | 28.5% |
| Rest = additives (dye, perfume, etc.) | to 100% |

| Example 3: granules | |
|---|---|
| Sodium tripolyphosphate | 14.0% |
| Sodium metasilicate | 5.2% |
| Sodium hydroxide | 1.5% |
| Sodium carbonate | 3.5% |
| ABS acid | 2.7% |
| Tallow alcohol + 14 EO | 1.1% |
| Na carbonate decahydrate | 31.5% |
| Na sulfate | 29.2% |
| Rest = additives (dye, perfume, etc.) | to 100% |

| Example 4: paste | |
|---|---|
| Sodium sulfate | 6.7% |
| Na tripolyphosphate | 38.5% |
| Nonionic surfactants: fatty alcohol + EO (5–12) | 11.6% |
| Fatty alcohol + EO (13–25) | 1.2% |
| Alkyl polyglucoside | 6.8% |
| Alkane sulfonate Na | 23.0% |
| Nitrilotriacetic acid (Na salt) | 2.8% |
| Rest = water, additives (dye, perfume, etc.) | to 100% |

These cleaners accommodated in elongate, water-soluble shells are placed in containers and then diluted with water for the preparation of the cleaning concentrate.

Example 5

A shaped cleaning body according to the invention weighing 15 g is placed in a 1 liter bottle. After the bottled has been filled with ca. 1 liter of water, it is shaken to form the liquid cleaning concentrate.

The advantages for the manufacturer, supplier, retailer (such as supermarkets) and the consumer are the sum total of all the advantages which concentrated products have over non-concentrated products: weight and volume are important factors in terms of general handling and production, transportation, storage, etc. Example 5 according to the invention is around 66 times lighter in weight than the conventional liquid cleaning concentrate, not including the weight of the bottle, and around 66 times smaller in volume.

Accordingly, a factory which, in the past, had produced and marketed 66 tons of conventional liquid cleaning concentrate would now only have to produce and market 1 ton. The advantages in regard to transportation, storage and further handling as far as the user are commensurate.

What is claimed is:

1. A process for the preparation of a cleaning concentrate comprising:

a) placing a shaped cleaning body in a bottle having a holding capacity of 0.3 to 10 liters, the shaped cleaning body consisting of a solid cleaner mass and a water-soluble polymeric shell consisting of polyvinyl alcohol, the shell surrounding the solid cleaner mass and having a narrow elongate form, the width of the shaped cleaning body at its widest point where it is cylindrical, elliptical or rectangular in shape being 1 to 3 cm and the length of the shaped cleaning body being at least 3.2 times its width at its widest point where it is cylindrical, elliptical or rectangular in shape; and b) filling the bottle with water.

2. A process as claimed in claim 1, characterized in that the bottle is made of plastic, glass or metal.

3. A process as claimed in claim 1, characterized in that the solid cleaner mass contains one or more surface cleaner ingredients selected from the group consisting of nonionic surfactants, anionic surfactants, cationic surfactants, amphoteric surfactants, carbonates, sulfates, phosphates, components with complexing properties, acids, perfume and dyes.

4. A process as claimed in claim 1, characterized in that the shaped cleaning body is contacted with water in a ratio by volume of 1:10 to 1:300 to provide a liquid cleaning concentrate which, on further dilution with water by a factor of 10 to 300, forms a ready-to-use solution for the cleaning of surfaces.

5. A process as claimed in claim 1, wherein placing the shaped cleaning body in the bottle is done before filing the bottle with water.

6. A process as claimed in claim 1, wherein filling the bottle with water is done before placing the shaped cleaning body in the bottle.

* * * * *